United States Patent [19]

Desty

[11] 4,336,017

[45] Jun. 22, 1982

[54] FLARE WITH INWARDLY DIRECTED COANDA NOZZLE

[75] Inventor: Denis H. Desty, Weybridge, England

[73] Assignee: The British Petroleum Company Limited, London, England

[21] Appl. No.: 871,531

[22] Filed: Jan. 23, 1978

[30] Foreign Application Priority Data

Jan. 28, 1977 [GB] United Kingdom ..... 03518/77

[51] Int. Cl.[3] ..... F23D 00/00

[52] U.S. Cl. ..... 431/202; 431/354; 239/DIG. 7

[58] Field of Search ..... 431/354, 202, 284; 239/DIG. 7; 417/189; 48/180 F

[56] References Cited

U.S. PATENT DOCUMENTS

| | | | |
|---|---|---|---|
| 3,914,093 | 10/1975 | Proctor | 431/35 X |
| 3,915,622 | 10/1975 | Desty et al. | 431/202 |
| 4,073,613 | 2/1978 | Desty | 431/354 |

FOREIGN PATENT DOCUMENTS

| | | |
|---|---|---|
| 1303439 | 9/1970 | United Kingdom . |
| 1381867 | 1/1975 | United Kingdom . |
| 1401763 | 7/1975 | United Kingdom . |

*Primary Examiner*—Samuel Scott
*Assistant Examiner*—G. Anderson
*Attorney, Agent, or Firm*—Morgan, Finnegan, Pine, Foley & Lee

[57] ABSTRACT

Flare for disposal of combustible gases which includes a Coanda nozzle using high pressure steam. The nozzle has a self adjusting slot and a low pressure fuel gas supply is entrained into the mouth of the nozzle.

10 Claims, 1 Drawing Figure

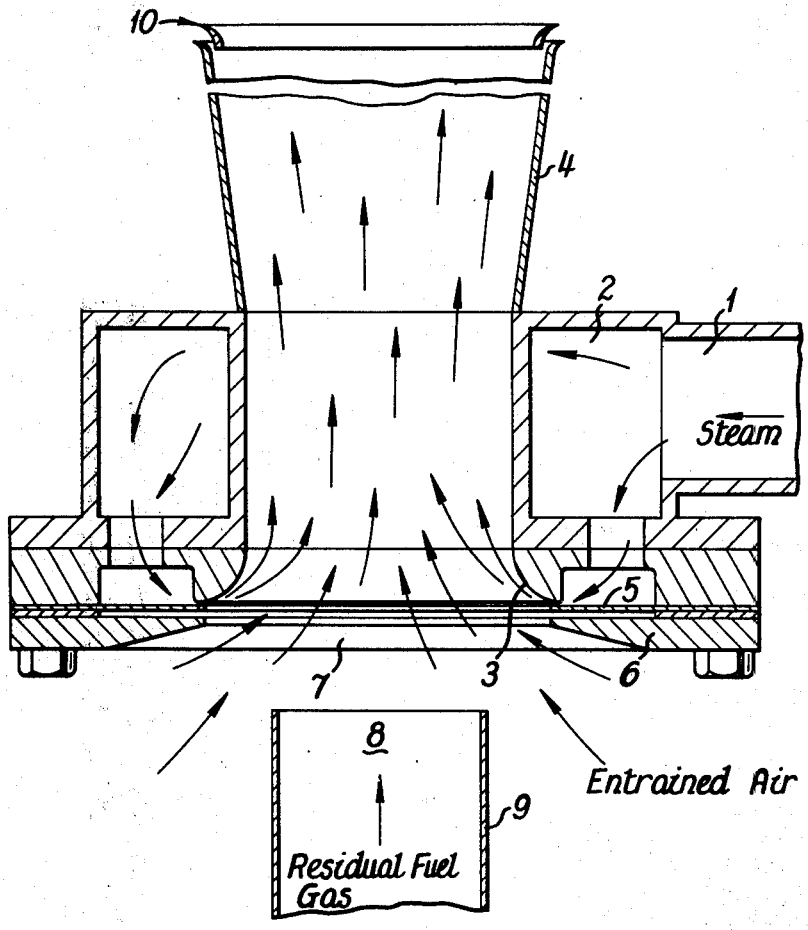
10
4
2
1
Steam
5
7
3
6
8
9
Residual Fuel Gas
Entrained Air

FLARE WITH INWARDLY DIRECTED COANDA NOZZLE

This invention relates to a flare for residual combustible gas, and in particular it relates to the disposal of refinery residual gases.

Refinery and chemical plant operation often requires that a vessel is vented through pressure relief valves into a vent system running at near atmospheric pressure. Gas from this low pressure vent system is then burnt off by flaring from an elevated stack so as to aid the dispersion of any oxide of sulphur that may be formed during combustion.

Since the low pressure of the gas precludes the use of air entrainment devices, the possible sulphur content makes ground level flaring in a natural draght flare impracticable, one way to improve combustion and reduce the amount of smoke formed during such emergency flaring operations is to add steam to the flared gas, which then reacts with any carbon particles by undergoing a water gas reaction, thus preventing smoke formation.

One type of flare suitable for the disposal of residual combustible gas utilises the Coanda principle and Coanda type flares can be either of the external type (e.g. as in our U.K. Pat. Nos. 1,303,439 or 1,381,867) or of the internal type (e.g. as in our U.K. Pat. No. 1,495,013).

Our U.K. Pat. No. 1,381,867 describes a method of disposing of low pressure fuel gases, which method comprises passing steam at pressure over a director body, the surface of which is curved so that the steam flow entrains surrounding air, said steam and air being passed into a supply of low pressure fuel gas emerging from an internal passageway of the director body, the resultant mixture of steam, air and fuel gas being ignited and burned.

Our U.K. Pat. No. 1,495,013 (hereinafter referred to as the parent patent) describes a Coanda unit comprising a supply line for a pressurised gas and a Coanda body positioned across the outlet of the supply line so as to define a slot for discharging the gas along the surface of the Coanda body, one edge of the slot being contiguous with the Coanda surface, the opposite edge of the slot being formed from a resilient flap capable of bending within defined limits in response to the pressure of the gas supply to vary the effective slot width.

The present invention describes a modification to the preferred internal type Coanda unit of the above mentioned application which, when used with steam as an air inducing medium, offers certain advantages in the disposal of residual low pressure combustible gases.

It is known that when an extension of one lip of the mouth of a slot through which a fluid emerges under pressure, progressively diverges from the axis of the exit of the slot, the extended lip thus creates a pressure drop in the surrounding fluid causing fluid flow towards the low pressure region. This physical phenomenon is known as the Coanda effect and a body exhibiting this effect is known as the Coanda body. A Coanda nozzle may thus be defined as a nozzle capable of discharging a fluid at high pressure into another fluid of low pressure through a narrow slot of chosen dimensions having a surface of a Coanda body substantially contiguous with one wall of the slot.

In the present invention, the Coanda nozzle has a fixed spatial relationship to the low pressure gas supply and does not require movement of the fuel gas outlet relative to the Coanda unit which is the arrangement of G.B. Pat. No. 1,401,763.

Thus according to the present invention there is provided a flare comprising a flow tube, one end of which flow tube communicates with a Coanda nozzle (as hereinbefore defined) one edge of the slot of the Coanda nozzle being contiguous with the Coanda surface, the opposite edge of the slot being formed from a resilient flap capable of bending within defined limits in response to the pressure of the gas supply to vary the effective slot width, characterised in that there are means for directing low pressure fuel gas into the flow tube, said means being in a fixed position relative to the Coanda nozzle during use of the flare.

The means for directing low pressure fuel gas is preferably either (a) a supply pipe having its outlet 0 to 150 mm spaced apart and upstream of the Coanda nozzle, or (b) a supply pipe within the flow tube and having its outlet 0 to 150 mm downstream of the Coanda nozzle arrangement.

Preferably the resilient flap of the Coanda nozzle is pre-loaded against the Coanda surface. The resilient flap is preferably an annular ring, the outer edge of the ring being held and the inner edge being free to move in response to the gas pressure from the Coanda nozzle. Most preferably the resilient flap of the flare comprises two or more co-axial rings of the same width and diameter.

The flow tube has an increasing cross-sectional area in a direction downstream from the Coanda nozzle, and most preferably takes the form of a cone having a semi-included angle of from 3° to 10°. The flare preferably has a baffle positioned at the outlet of the flow tube which may be of the type described in the U.S. patent application Ser. No. 736,312, filed Oct. 28, 1976, assigned to the British Petroleum Company Limited.

The invention also includes a method for the disposal of low pressure fuel gases wherein the low pressure fuel gas is directed into the flow tube of a flare (as hereinbefore described), there being a high pressure gas emerging from the Coanda nozzle which entrains the low pressure fuel gas and surrounding air along the flow tube, the resultant mixture being combusted at or above the outlet of the flow tube. The high pressure gas is preferably steam but may also be a high pressure fuel gas. An array of the flare units may be used, for example, when flaring large quantities of gas.

The invention will now be described by way of example only with reference to the accompanying drawing.

The drawing shows a diagrammatic representation of a flare for the disposal of low pressure residual fuel gases by use of high pressure steam.

Steam is fed into the Coanda section of the flare by means of an inlet pipe 1. The Coanda section of the flare comprises an annular steam chamber 2 which connects with an internal Coanda surface 3 of a Coanda nozzle at the throat of a diverging flow tube or trumpet 4 when a deformable element 5 is opened by the steam pressure.

The deformable element 5 takes the form of an annular ring which is clamped at its outer edge to the main body of the flare unit. A spacer (not shown) is used to adjust the position of the annular ring depending on the pressures used and a limit plate 6 restricts the movement of the ring 5 to avoid deformation occurring.

In use of the flare unit, high pressure steam enters the chamber 2 from inlet pipe 1. At a pre-determined pressure, the steam pressure in chamber 2 causes the deformable ring 5 to open, thus allowing steam to pass over the internal Coanda surface 3 to the throat of the Coanda body and thence upwards through the flow tube 4 to emerge at the combustion zone above the outlet of flow tube 4.

At a fixed distance below the mouth 7 of the Coanda body, there is positioned the outlet 8 of a pipe 9 connected to a supply of residual fuel gas. The Coanda effect causes entrainment of surrounding primary air so that a mixture of steam and air passes along the tube 4 to the combustion zone, and the residual fuel gas discharging from the outlet 8 is entrained with this steam and air mixture. The mixture of air, steam and residual fuel gas is burned in a combustion zone above the outlet of flow tube 4. A flame stabilising ring 10 may be used at the outlet of flow tube 4.

Optimum operating conditions, e.g. to achieve clean smoke free combustion of the residual fuel gas, are achieved by adjustment of the steam pressure.

The dimensions of the flare unit are as follows:

| | |
|---|---|
| Coanda trumpet mouth diameter | = 350 mm |
| Coanda trumpet throat diameter | = 217 mm |
| Coanda trumpet semi-included angle | = 3.5° |
| Annular ring external diameter at clamp point | = 402 mm |
| Annular ring internal diameter | = 274 mm |
| Annular ring thickness | = 2.52 mm |
| Annular ring material ("Ferralium" is a trade mark) | = "Ferralium" stainless steel |
| Annular ring maximum deflection (gap) | = 1.27 mm |

The following table shows results obtained with this variable slot internal Coanda flare unit.

TABLE 1

| Test No. | STEAM Pressure lb/in$^2$ | STEAM Flow Rate lb/hour | FUEL GAS Flow Rate ft$^3$/hour | Gas to Steam Ratio (wt./wt.) | Remarks |
|---|---|---|---|---|---|
| 1 | 5.5 | 285 | 12390 | 4.1 | Flame invisible in sunlight |
| 2 | 5.5 | 285 | 40710 | 13.5 | Smoke point |
| 3 | 5.5 | 285 | 56640 | 18.7 | Smoky flame |
| 4 | 9 | 565 | 12980 | 2.2 | Flame invisible and noisy |
| 5 | 9 | 565 | 19470 | 3.3 | Flame just invisible in daylight |
| 6 | 9 | 565 | 48340 | 8.1 | Almost on smoke point |
| 7 | 16 | 1300 | 42480 | 3.1 | Flame invisible |
| 8 | 16 | 1300 | 20060 | 1.5 | Short, noisy, unstable flame |
| 9 | 16 | 1300 | 14750 | 1.1 | Flame extinguished |
| 10 | 16 | 1300 | 35400 | 2.6 | Short, vertical blue flame |

The low pressure fuel gas of density about 1.3 was introduced into the mouth of the Coanda flare through a 150 mm nominal bore pipe terminating 55 mm below the lower face of the unit.

In general at low and medium fuel gas flows, smoke does not form in the flame until the gas to steam ratio exceeds 10 to 1. The flame is made virtually invisible at a gas to steam ratio of 5 to 1, further reduction in this ratio causes combustion noise and flame instability with the pilot light (not shown) keeping the flame alight. The flame is extinguished when the ratio reaches approximately 1.5 to 1.

The examples illustrate how the flame varies with steam pressure. The use of the variable slot Coanda flare enables a wider range of steam flow rates to be attained by use of a much smaller range of steam pressures. This enables wider ranges of low pressure fuel gas flows to be disposed of, and improves steam economy at low residual gas flows.

Further tests were carried out using a larger Coanda flare system. The dimensions of the second flare unit used were as follows:

| | |
|---|---|
| Coanda trumpet mouth diameter | = 1007 mm |
| Coanda trumpet throat diameter | = 800 mm |
| Coanda trumpet semi-included angle | = 4½° |
| Annular ring external diameter at clamp point | = 1075 mm |
| Annular ring internal diameter | = 844.3 mm |
| Length of annular ring free movement | = 75 mm |
| Annular ring thickness | = 10 gauge |
| Annular ring material | stainless steel (304) |
| Annular ring maximum deflection | = 0.6 mm |

In these tests, three annular rings in parallel were used in order to reduce the tendency of the rings to oscillate in use. The distance of the 600 mm diameter steam pipe below the clamp point of the annular rings was about 25 mm.

The results obtained are shown in Table 2 below.

TABLE 2

| Remarks | Steam Manifold Pressure psig | Steam Flow LB/HR | Steam Flow KG/HR | Gas Flow LB/HR | Gas Flow KG/HR | Ratio wt/wt. |
|---|---|---|---|---|---|---|
| Smoke point | 19.5 | 1800 | 816 | 9906 | 4493 | 5.5 |
| Smoke point | 21.0 | 2150 | 975 | 18458 | 8372 | 8.6 |
| Smoke point | 24.5 | 2900 | 1315 | 24980 | 11331 | 8.6 |
| Flame invisible in daylight | 37.5 | 7150 | 3243 | 17472 | 7925 | 2.4 |

I claim:

1. A flare, comprising:

a flow tube having an inlet end portion and an outlet end portion;

said inlet end portion of said flow tube including a Coanda nozzle directed towards the interior of said flow tube;

means for passing a pressurized gas through said Coanda nozzle and thereafter, together with entrained surrounding gas, along the inside of said flow tube;

said flow tube transporting the gas flow to the outlet end portion thereof;

said Coanda nozzle including a circumferentially extending outlet slot through which said pressurized gas flows and a circumferentially extending Coanda surface inside said flow tube contiguous with one edge of said Coanda nozzle outlet slot, the opposite edge of said Coanda nozzle outlet slot comprising a resilient flap arranged to flex in response to the pressure of said pressurized gas passing through said Coanda nozzle outlet slot to vary the effective slot width thereof;

said resilient flap comprising an annular ring, the outer circumferentially extending edge of which is fixed while the inner circumferentially extending edge thereof is free to move in response to said pressure of said pressurized gas; and means for directing low pressure gas into the inlet portion of said flow tube, said means located at a predetermined fixed spatial position relative to said Coanda nozzle during use of the flare.

2. A flare according to claim 1, in which the means for directing low pressure fuel gas is a supply pipe having its outlet 0 to 150 mm spaced apart and upstream of the Coanda nozzle.

3. A flare according to claim 1 in which the means for directing low pressure fuel gas is a supply pipe within the flow tube and having its outlet 0 to 150 mm downstream of the Coanda nozzle.

4. A flare according to claims 1, 2 or 3 in which said resilient flap is pre-loaded against said Coanda surface.

5. A flare according to claim 1 wherein said resilient flap comprises two or more co-axial annular rings of the same annular width and diameter.

6. A flare according to claims 1 or 5 in which the flow tube has an increasing cross-sectional area in a direction downstream from the Coanda nozzle.

7. A flare according to claim 6, including a baffle positioned at the outlet portion of said flow tube.

8. A flare according to claim 6 in which said flow tube has the form of a cone having a semi-included angle of from 3° to 10°.

9. A flare according to claim 8, including a baffle positioned at the outlet portion of said flow tube.

10. A flare according to claims 1 or 5 having a baffle positioned at the outlet portion of said flow tube.

* * * * *